United States Patent [19]

Maxwell

[11] Patent Number: 4,912,789

[45] Date of Patent: Apr. 3, 1990

[54] WATERBED MATTRESS

[75] Inventor: Peter Maxwell, Orange, Calif.

[73] Assignee: Hi Life Products, Inc., Chino, Calif.

[21] Appl. No.: 306,589

[22] Filed: Feb. 6, 1989

[51] Int. Cl.[4] ..... A47C 27/10

[52] U.S. Cl. ..... 5/450; 5/451

[58] Field of Search ..... 5/450, 451, 449, 455, 5/422, 452, 441

[56] References Cited

U.S. PATENT DOCUMENTS

| | | | |
|---|---|---|---|
| Re. 32,420 | 5/1987 | Autrey et al. | 5/451 |
| 779,576 | 1/1905 | Berryman | 5/455 |
| 3,456,270 | 7/1969 | Weinstein et al. | 5/451 |
| 3,766,579 | 10/1973 | Shields | 5/451 |
| 3,872,525 | 3/1975 | Lea et al. | 5/450 |
| 4,186,455 | 2/1980 | Fox, Jr. et al. | 5/451 |
| 4,197,602 | 4/1980 | Johenning | 5/451 |
| 4,221,013 | 9/1980 | Echevarria | 5/451 |
| 4,334,331 | 6/1982 | Santo | 5/451 |
| 4,411,033 | 10/1983 | Morgan | 5/451 |
| 4,521,929 | 6/1985 | Keefer | 5/451 |
| 4,528,704 | 7/1985 | Wegener et al. | 5/455 |
| 4,558,476 | 12/1985 | Linder | 5/451 |
| 4,571,762 | 2/1986 | Rhoton et al. | 5/451 |
| 4,611,357 | 9/1986 | Chelin | 5/451 |
| 4,619,007 | 10/1986 | Echevarria et al. | 5/451 |
| 4,638,518 | 1/1987 | Barbulla | 5/451 |

FOREIGN PATENT DOCUMENTS

| | | | |
|---|---|---|---|
| 107116 | 4/1967 | Denmark | 5/422 |
| 2801 | 7/1878 | United Kingdom . | |

*Primary Examiner*—Alexander Grosz

*Attorney, Agent, or Firm*—Terje Gudmestad

[57] ABSTRACT

A waterbed mattress is disclosed having a cushioned box shaped frame with a base sheet securely attached to the box shaped frame, the combination forming therein cavity. A plurality of elongated fluid filled containers are disposed within the cavity, and two flat rectangularly shaped fluid filled envelopes are disposed over the elongated containers. The base sheet serves to hold the box shaped frame in substantially a rectangular shape. Additionally, the flat fluid filled envelopes provide a mattress with improved wave motion damping characteristics.

13 Claims, 3 Drawing Sheets

WATERBED MATTRESS

BACKGROUND OF THE INVENTION

1. Field of the Invention

This invention relates generally to flotation sleep systems and more particularly to a waterbed mattress having a stacked arrangement of fluid filled containers laterally supported within a rigid frame structure.

2. Description of Related Art

Over the past twenty (20) years waterbeds have enjoyed increasing popularity since they provide both personal and therapeutic comfort through buoyant support not offered by conventional spring mattresses. Conventional waterbed structures consist of a unitary water filled bladder with some type of retaining wall to laterally support the bladder therein to a confined area. Typical examples of such conventional structures are disclosed in Fox, Jr. et al, U.S. Pat. No. 4,186,455, Autrey et al, U.S. Pat. Reissue No. 32,420, Johenning, U.S. Pat. No. 4,197,602 and Santo, U.S. Pat. No. 4,334,331. The waterbed structures disclosed in these patents, however, all suffer from several of the following disadvantages, namely, wave motion, excessive weight, bowing of retaining walls, difficulty in moving, filling and emptying, limited buoyancy adjustment, hardness, mattress water leaks and multiple user wave motion discomfort.

Attempts have been made to eliminate one or more of these disadvantages with limited success. For example, Echevarria, U.S. Pat. No. 4,221,013 discloses a waterbed structure including a foam box filled with a series of elongated water filled containers. Leaks are limited to each separate container and wave motion is reduced. However, although wave motion may be confined principally within individual containers, there is still considerable wave motion within each container especially along the longitudinal extent of such containers. Additionally, it is very difficult to fill each and every container with the same amount of water. Uneven filling causes the buoyancy support provided by the mattress and therefore the comfort to change over the sleeping area of the bed.

More progressive attempts to develop a waterbed structure include mattress arrangements which have both water chambers and air chambers as disclosed in Linder U.S. Pat. No. 4,558,476, Barbulla U.S. Pat. No. 4,638,518 and Shields, U.S. Pat. No. 3,766,579. In Linder, a waterbed configuration is disclosed including a fluid filled envelope wherein are suspended resilient material, and an air mattress located beneath the resilient material. Valves are coupled to the various chambers to vary the pressure and consequently the supporting forces in each chamber. Barbulla discloses a mattress comprising at least three intergral chambers: one chamber being divided into upper and lower water filled chamber portions, the lower chambers containing particulate buoyant materials; the other chambers being filled with air, which chambers are located along the longitudinal sides of the mattress and at the bottom of the mattress. Shields discloses a waterbed comprising an air beam structure which acts as the supporting frame. The air beam incorporates a bottom sheet to retain any leaking water. An air mattress is positioned within the frame work of the air beam, and the air mattress supports a water filled envelope positioned thereupon.

Unfortunately while certain disadvantages are overcome by these water and air chambered waterbed structures, the patented structures result in additional disadvantages which render them commercially undesirable for providing substitutes for the relatively inexpensive conventional waterbed described above. For example, in each instance structure the mattress bladder is much more complex than conventional structures and not conducive to low cost manufacturing techniques.

While many waterbed structures have evolved over the last 20 years, no inexpensive, yet reliable waterbed structures have been realized to effectively deal with many of the aforementioned disadvantages which have plagued the industry for many years.

SUMMARY OF THE INVENTION

It is therefore an object of this invention to provide a waterbed mattress that is simple and inexpensive to manufacture.

It is another object of this invention to provide a waterbed mattress having improved wave motion damping characteristics.

It is still a further object of this invention to provide a waterbed mattress with a simple frame construction that is comfortable to sit on yet provides lateral support for a water filled envelope therein.

A waterbed mattress according to the present invention includes a box shaped frame made of resilient material having securely attached thereto a dimensionally stable base sheet, the frame and the base sheet forming a cavity therein. A plurality of elongated fluid filled containers are disposed within the cavity. Two flat rectangularly shaped fluid filled containers are disposed over the elongated fluid containers. While the stacked arrangement of fluid filled containers provide improved wave motion damping characteristics, the dimensionally stable base sheet restrains the frame from bending outward due to the lateral force from the fluid filled containers.

Other and further objects, advantages and characteristic features of the present invention will become readily apparent from the following detailed description of preferred embodiments of the invention when taken in conjunction with the accompanying drawings.

DETAILED DESCRIPTION OF THE INVENTION

Figure 1:
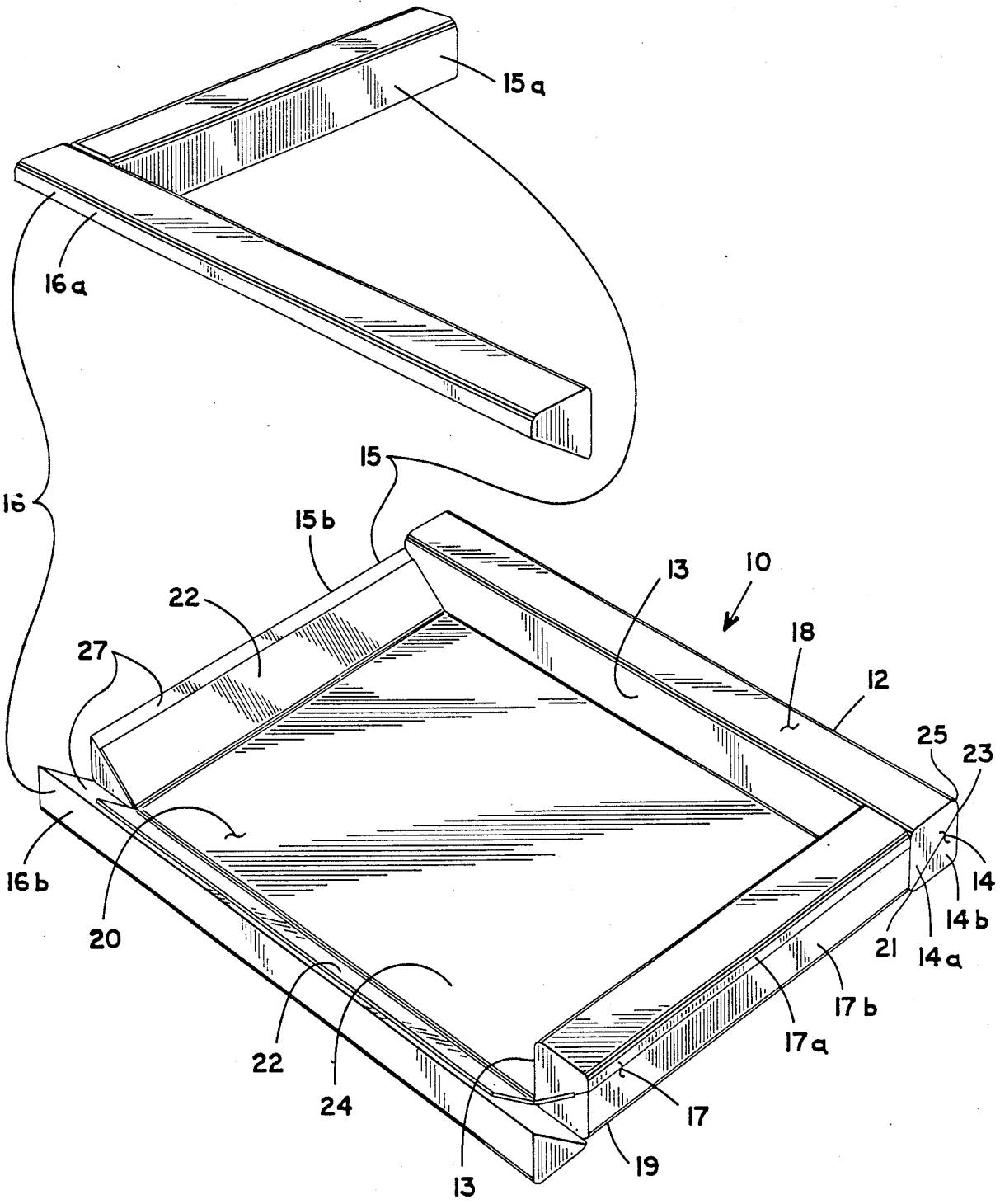
FIG. 1 is a perspective view, partially exploded, of a waterbed frame structure in accordance with the invention.

Referring now with greater particularity to FIGS. 1, a waterbed mattress frame structure 10 is shown having box-shaped frame 12 made of four beams 14, 15, 16 and 17 of compressible and resilient cushion material, which may be foam or urethane material, for example. The four beams 14–17 typically have square or rectangular cross-section. However, the beams may have a cross section comprising a right trapezoid with the top of the beams 18 having a greater width than the bottom of the beams 19.

A base sheet 20 of dimensionally stable material is securely attached to the four beams 14–17, forming a bottom surface. The base sheet 20 may be made of any material that does not stretch substantially such as reinforced fabric or polyethylene netting, for example. In securing the base sheet 20 to the frame 12, the outer perimeter of the base sheet 20 is embedded and bonded within the four beams 14–17. One way to achieve this structure is to cut the four beams 14–17 diagonally in half and reassemble the four beams gluing the base sheet therebetween. More specifically as shown in FIG. 1, the four beams 14–17 are each cut from the lower inner edge 21 through the upper out side area 23, a short distance down from the upper outer edge 25. The tabs 22 of the base sheet 20 are glued to the inner surfaces 27 of the bottom beam portions **14*b*–17*b*. The top beam portions 14*a*–17*a* are then glued to the lower beam portions 14*b*–17*b* and tabs 22. At the same time the respective end portions of the beams are glued together. The beams are thereby reassembled with the tabs 22 and consequently the base sheet 20 therebetween. The base sheet 20 holds the four beams 14–17 substantially securely in place preventing them from bowing outwardly due to lateral pressure from a waterbed mattress. The beams 14–17 may also be cut partially through (not shown) diagonally from the lower inner edge 21 in a direction angled upwardly towards the upper outer side area 23. The tabs 22 are slidably inserted into the cuts of the respective beams and glued therebetween. The four beams 14–17 are also glued together. In either of the above described mattress frame structures, since the base 20 sheet is attached along the extent of all four beams 14–17**, the entire frame is laterally supported, which is a feature lacking in conventional frame structures.

Figure 2:
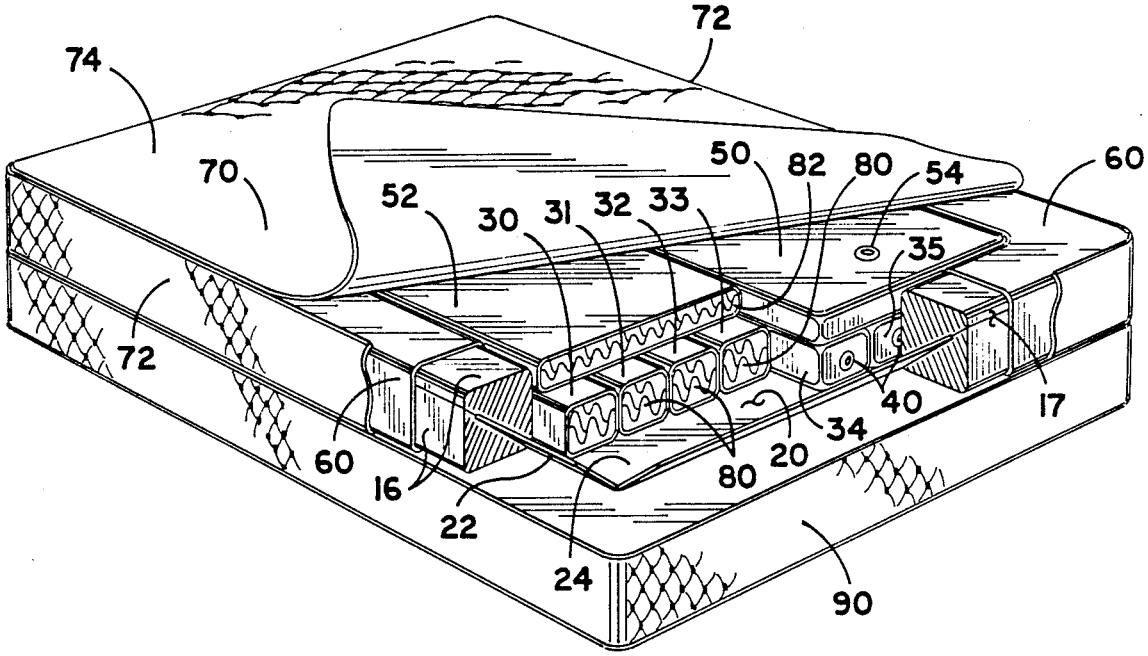
FIG. 2 is a perspective view, partially broken away, of waterbed mattress arrangement according to the invention, including the frame structure of FIG. 1.
Figure 3:
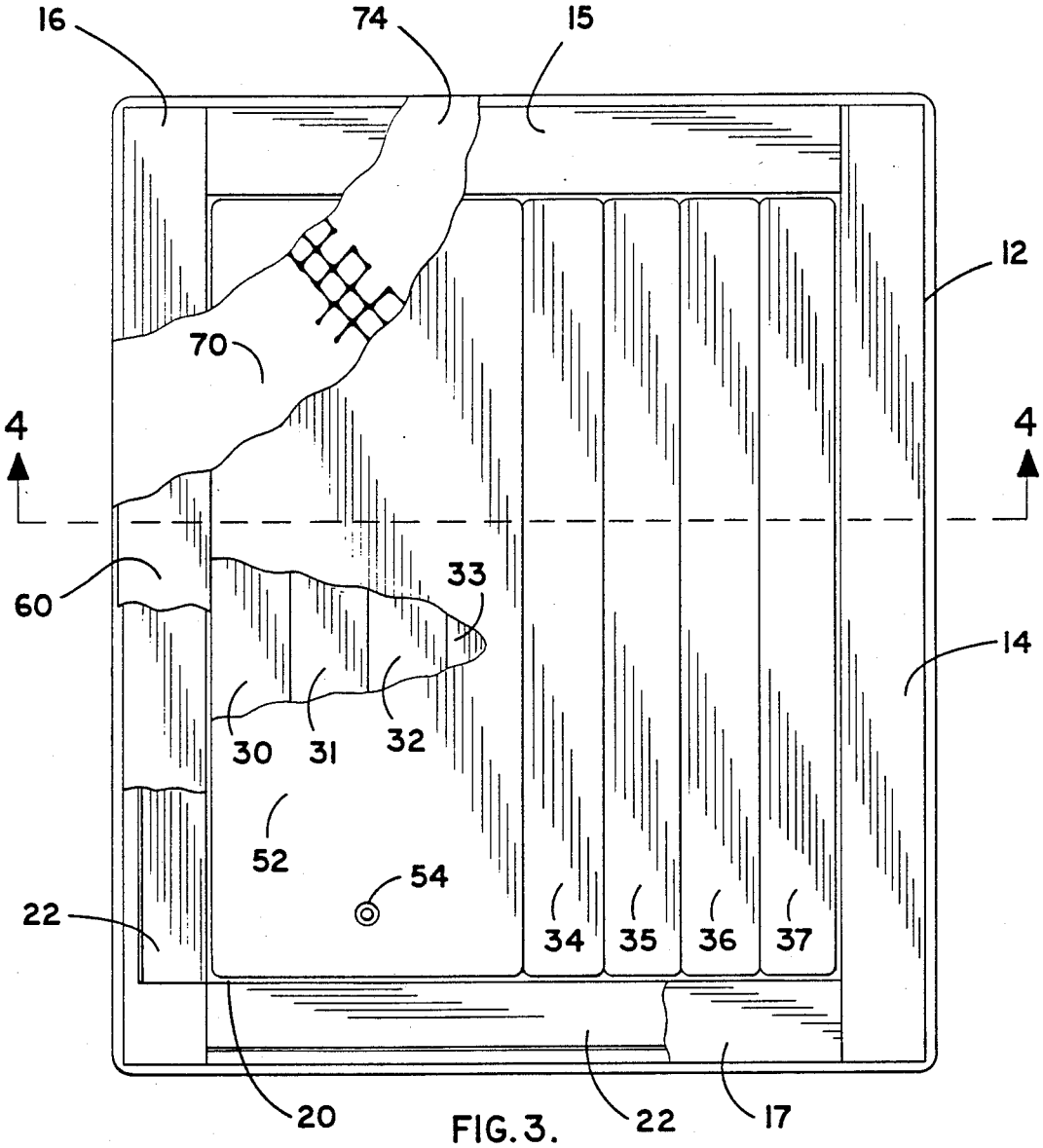
FIG. 3 is a top view, partially broken away, of the waterbed mattress shown in FIG. 2.
Figure 4:
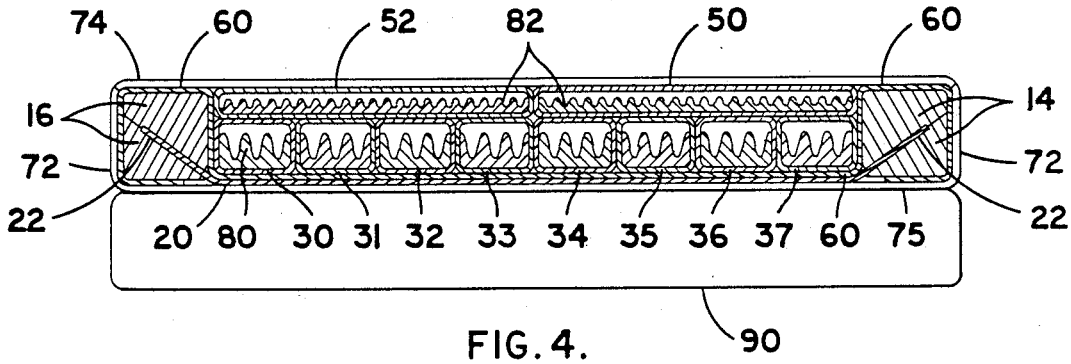
FIG. 4 is an end sectional view of the waterbed mattress in cross-section taken along lines 4—4 of FIG. 3.

The box shaped frame 12 and base sheet 20 define a cavity 24 therein. While the frame 12 and base sheet 20 provide an improved retaining structure for any fluid filled mattress structure, the mattress arrangement described and shown in FIGS. 2–4 is preferred. A plurality of elongated tubularly shaped fluid filled containers 30 through 37 are adjacently positioned in the cavity 24 on base sheet 20, which substantially fill the cavity. The elongated fluid filled containers 30–37 may be made of materials well known in the art such as plastic, for example. The elongated containers 30–37 preferably have a substantially circular cross section, and can be manufactured by heat sealing calendered sheets of vinyl using standard techniques well known in the art. The elongated containers 30–37 shown conform to a rectangular shape when covered by flat fluid filled containers 50 and 52 described below. Each individual elongated container 30–37 includes a filling spout means 40 which may include an invertible spout with a plug inserted therein and a cap, all of which are well known in the waterbed industry. In this description of the preferred embodiment, eight elongated tubularly shaped fluid filled containers are shown and may be about four inches in diameter, for example.

Two flat rectangularly shaped fluid filled containers 50 and 52 are positioned over the eight elongated tubularly shaped fluid filled containers 30–37, one of the flat containers 50 covering the extent of four of the elongated containers 30–33 and the other 52 covering the extent of the other four elongated containers 34–37. Containers 50 and 52, as clearly seen in FIGS. 2 and 4, are six sided containers with substantially rectangular top and bottom faces, substantially rectangular front and back faces and substantially rectangular left and right faces. When filled with water, containers 50 and 52 are identified as flat, rectangularly shaped water filled containers. The cross sectional thickness of the flat containers 50 and 52 may be about one to two inches, for example. The flat containers 50 and 52 are made of the same materials as the elongated tubularly shaped containers, and manufactured by well known techniques. Each flat fluid filled container 50 and 52 has a filling spout means 54 which includes an invertible spout, internal plug and cap.

The two flat rectangularly shaped fluid filled containers 50 and 52 avoid the problem of uneven tube filling in prior art waterbed structures. The flat rectangularly shaped containers even out the water distribution over the entire extent of the bed so the user experiences the same buoyancy in any area of the bed. Furthermore, the two flat containers 50 and 52 separate the bed into two sleep areas such that if the bed is used by two persons, wave motion by one person will be more readily isolated from the other person.

Above is described is a basic waterbed mattress with improved structural characteristics. However, a water retaining liner 60 may also be employed with the basic waterbed structure. The liner 60, which may be vinyl or plastic, extends beneath the fluid filled containers 30–37, between the inside walls 13 of the four beams 14–17 and the outer edge of the fluid filled containers 30, 37, 50 and 52 and around the outer surface of the four beams 14–17 of the frame. The retaining liner 60 holds any water that may be spilled in the cavity area 24. Additionally, a quilted coverlet or outer shell 70 may be employed to enclose the basic waterbed structure. Side quilted margins 72 extend around the periphery and a quilted top panel 74 is attached thereto by a zipper, for example. The bottom surface 75 of the shell extends under the beams and base sheet being attached to the quilted margins 72.

To achieve additional wave motion damping the fluid filled containers 30–37, 50 and 52 may each include slabs 80 and 82 of substantially open celled foam or cellulosic sponge substantially submerged in the respective containers, as described in U.S. Pat. No. 4,411,033 which is incorporated herein by reference. The slabs 80 and 82 shown are of an egg crate design and may be of opened celled foam consisting of polyurethane or rubber, vinyl or neoprene, and may have a specific gravity less than the liquid fill in the fluid filled containers, for example. Alternatively, the elongated containers 30–37 may have slabs 80 while the flat containers 50 and 52 do not have any slabs therein, or none of the fluid filled containers may have slabs.

The basic waterbed structure is typically positioned on a support base 90, which may be a conventional box mattress. However, the support base may comprise a wood frame (not shown) made of four sides and a bottom. Alternatively, the mattress structure may simply be placed on the floor without using any of the above described bases. A heat unit (not shown) may be positioned underneath a portion of the cavity, to adjust the temperature comfort level desired by the user.

A new and improved waterbed is thus provided. However, various modifications may be made to the above-described preferred embodiment without departing from the scope of the invention. For example, the above-described invention has been described in reference particular suitable for a queen size waterbed. However, the principles apply equally well to other waterbed sizes, such as king size, full size or twin size. For example, for a king size waterbed, preferable ten elongated tubularly shaped fluid filled containers may be used under two flat rectangularly shaped fluid filled containers. For a full size waterbed, seven elongated containers are typically placed under the two flat fluid filled containers. In a twin size waterbed, one flat rectangular shaped fluid filled container is preferably used with five fluid filled tubes thereunder, for example. Accordingly, it should be understood that although the invention has been described and shown for one particular embodiment, nevertheless various changes and modifications obvious to a person ordinary skill in the art to which the invention pertains are deemed to lie within the spirit and scope of the invention as set forth in the following claims.

What is claimed is:

1. A waterbed mattress construction, comprising:

box shaped frame means, made of resilient cushion material;

a base sheet attached to said box shaped frame means, the base member and frame means providing therein a cavity;

a plurality of elongated tubularly shaped water filled containers adjacently disposed in the cavity on said base sheet; and a pair of flat rectangularly shaped water filled containers adjacently stacked over said elongated tubularly shaped water filled containers, said cavity being substantially filled by said tubularly and rectangularly shaped containers, said rectangularly shaped containers substantially covering said tubularly shaped containers.

2. The water bed mattress defined in claim 1 further comprising an outer shell removably mounted over said box shaped frame means.

3. The water bead defined in claim 2 further comprising sponge material disposed in said tubularly shaped water filled containers and flat rectangularly shaped water filled containers.

4. The waterbed mattress defined in claim 3 further including a retaining liner means disposed in said cavity between said frame means and containers, and said base sheet and said water filled containers for catching any water spilled within the cavity.

5. A waterbed mattress, comprising:

a base support member;

a box-shaped frame disposed on said base support member, said frame and base support member forming a cavity therein;

a plurality of elongated tubularly shaped water filled containers adjacently disposed within the cavity; and two flat rectangularly shaped water filled containers adjacently disposed over said elongated water filled containers, said cavity being substantially filled by said tubularly and rectangularly shaped containers, said rectangularly shaped containers substantially covering said tubularly shaped containers.

6. The water mattress defined in claim 5 wherein each of said water filled containers has substantially open cell foam disposed therein.

7. The waterbed mattress defined in claim 5 wherein said two flat rectangularly shaped containers are about one to two inches thick.

8. A waterbed mattress, comprising:

a box shaped frame having a cavity therein;

a plurality of elongated tubularly shaped water filled containers adjacently disposed with the cavity; and two flat rectangularly shaped water filled containers adjacently disposed over said elongated water filled containers wherein said two flat rectangularly shaped water filled containers are about one to two inches thick, said cavity being substantially filled by said tubularly and rectangularly shaped containers, said rectangularly shaped containers substantially covering said tubularly shaped containers.

9. The waterbed mattress defined in claim 8 wherein said plurality of water filled containers is at least eight, at least four of said at least eight water filled containers being disposed under one of said two flat containers and at least another four of said at least eight water filled containers being disposed under the other of said two flat containers.

10. The waterbed mattress defined in claim 9 further comprising base support means disposed under said box-shaped frame.

11. The waterbed mattress defined in claim 10 wherein each of said elongated containers has substantially open cell foam disposed therein.

12. The waterbed mattress defined in claim 11 wherein each of said flat rectangularly shaped containers has substantially open cell foam disposed therein.

13. The waterbed mattress defined in claim 11 further including retaining liner means disposed in said cavity between said box-shaped frame and said containers, said base support member and said water filled containers for catching any water spilled within the cavity.

* * * * *